US008191454B2

(12) United States Patent
Dupont

(10) Patent No.: US 8,191,454 B2
(45) Date of Patent: Jun. 5, 2012

(54) CANISTERIZED INTERCEPTOR WITH EMBEDDED WINDINGS AND METHOD FOR SAFE ROUND DETECTION

(75) Inventor: James H. Dupont, Bowie, AZ (US)

(73) Assignee: Raytheon Company, Waltham, MA (US)

( * ) Notice: Subject to any disclaimer, the term of this patent is extended or adjusted under 35 U.S.C. 154(b) by 852 days.

(21) Appl. No.: 12/146,181

(22) Filed: Jun. 25, 2008

(65) Prior Publication Data

US 2012/0036986 A1 Feb. 16, 2012

(51) Int. Cl.
*F41F 3/04* (2006.01)

(52) U.S. Cl. ..... 89/8; 89/1.812; 89/1.816; 89/1.817

(58) Field of Classification Search ..... 89/8, 1.8, 89/1.806, 1.807, 1.812, 1.816, 1.817
See application file for complete search history.

(56) References Cited

U.S. PATENT DOCUMENTS

| | | | | |
|---|---|---|---|---|
| 4,137,819 | A * | 2/1979 | Loomis, III | 89/1.813 |
| 4,324,168 | A * | 4/1982 | Sano et al. | 89/1.814 |
| 4,359,926 | A * | 11/1982 | Sano et al. | 89/1.814 |
| 5,208,422 | A * | 5/1993 | Moody | 89/1.809 |
| 5,742,609 | A | 4/1998 | Kondrak et al. | |
| 6,277,771 | B1 | 8/2001 | Nishimura et al. | |
| 6,526,860 | B2 | 3/2003 | Facciano et al. | |
| 7,406,909 | B2 * | 8/2008 | Shah et al. | 89/36.02 |
| 7,549,365 | B2 * | 6/2009 | Root, Jr. | 89/1.819 |
| 2006/0053534 | A1 * | 3/2006 | Mullen | 2/456 |
| 2007/0234893 | A1 * | 10/2007 | Lockner et al. | 89/8 |

FOREIGN PATENT DOCUMENTS

WO WO-2010008481 A1 1/2010

OTHER PUBLICATIONS

"International Application Serial No. PCT/US2009/003774, Written Opinion mailed Aug. 27, 2009".

* cited by examiner

*Primary Examiner* — Gabriel Klein
(74) *Attorney, Agent, or Firm* — Schwegman, Lundberg & Woessner, P.A.

(57) ABSTRACT

Embodiments of a canisterized interceptor and method to prevent the launch of a canisterized interceptor that may have been penetrated by small arms fire are generally described herein. In some embodiments, the canisterized interceptor includes a composite canister for housing an interceptor. The canister includes an embedded winding to provide a conductive path and comprises a conductor arranged within composite material of the canister. A maximum spacing may be provided between windings of the conductor and penetration of the canister may be indicated by an open or short circuit in the conductive path.

22 Claims, 2 Drawing Sheets

CANNISTERIZED INTERCEPTOR

CANNISTERIZED INTERCEPTOR

CANISTERIZED INTERCEPTOR WITH EMBEDDED WINDINGS AND METHOD FOR SAFE ROUND DETECTION

TECHNICAL FIELD

Embodiments of the present invention pertain to canisterized interceptors, sometimes referred to missile rounds.

BACKGROUND

A canisterized interceptor generally includes a missile assembly and its canister. The canister provides a means to store, transport and launch the missile, and can maintain the missile in ready condition for several years. One concern with canisterized interceptors is that they may be damaged by small-arms fire, making the interceptor unsafe to launch during mission operations. Conventional techniques to protect canisterized interceptors from small arms fire include providing a defensive shield, such as armor, around the perimeter of the canisterized interceptors. These conventional techniques result in a substantial increase in weight and are generally not suitable for applications where weight is a concern.

Thus, there are general needs for canisterized interceptors and methods that prevent the launch of an interceptor damaged by small arms fire. There are also needs for canisterized interceptors that prevent the launch of an interceptor damaged by small arms fire suitable for use in applications, such as airborne and maritime applications, where weight is a concern.

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for those of other embodiments. Embodiments set forth in the claims encompass all available equivalents of those claims.

Figure 1:
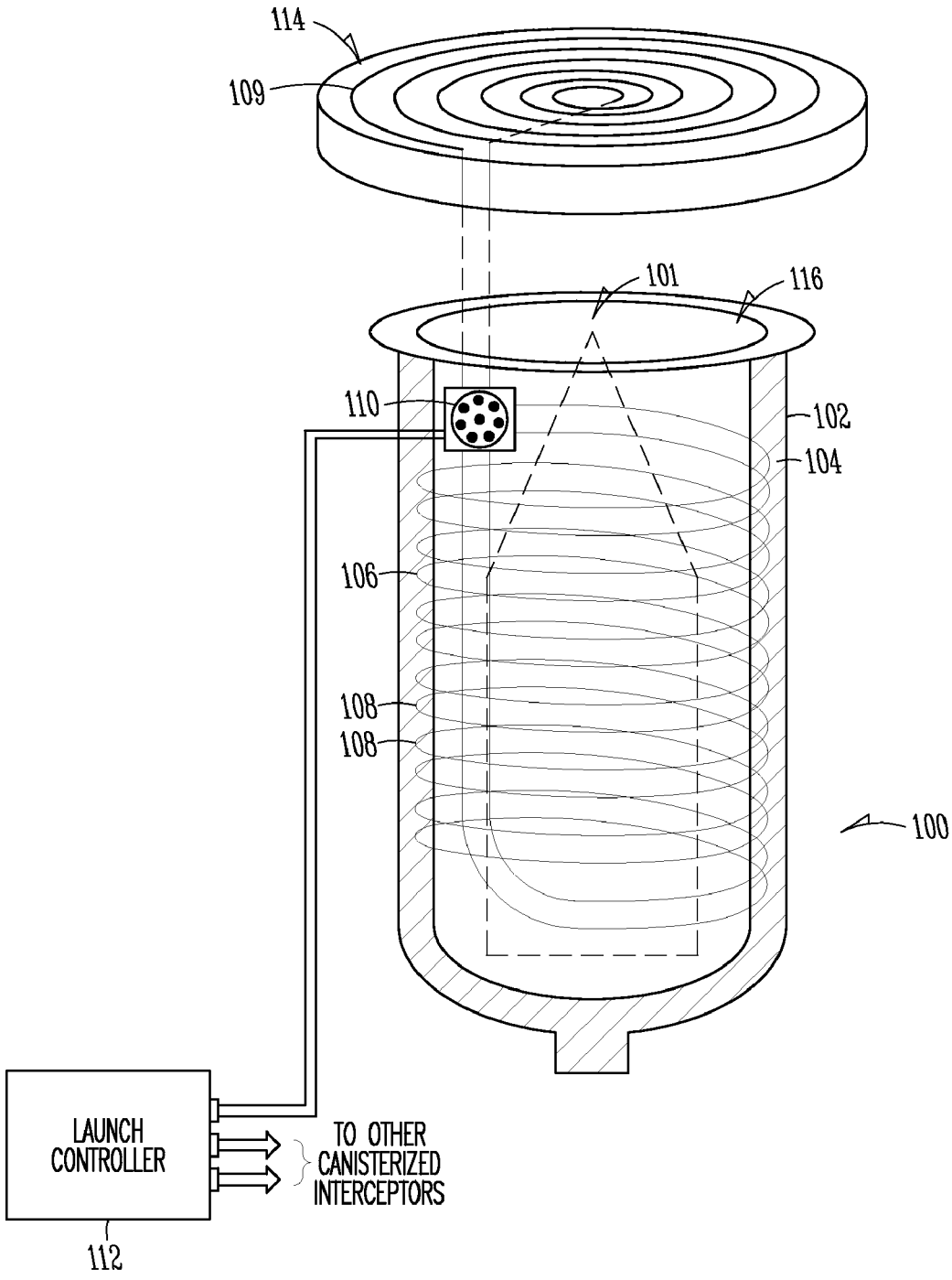
FIG. 1 is a functional diagram of a canisterized interceptor and launch controller in accordance with some embodiments.

FIG. 1 is a functional diagram of a canisterized interceptor and launch controller in accordance with some embodiments. Canisterized interceptor 100 includes composite canister 102 for storing or housing interceptor 101. In accordance with embodiments, composite canister 102 has embedded winding 106 therein to provide a conductive path. Embedded winding 106 may comprise conductor 108 arranged within composite material 104 of composite canister 102. A maximum spacing between windings of conductor 108 may be provided. Penetration of the canister may be indicated by an open or short circuit in the conductive path provided by embedded winding 106. Interceptor 101 may be a missile or a missile round, although the scope of the embodiments is not limited in this respect.

Figure 2:
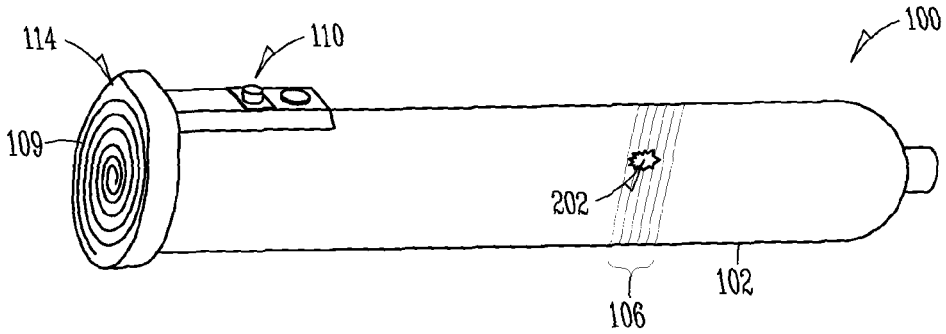
FIG. 2 illustrates a perspective view of the canisterized interceptor of FIG. 1 in accordance with some embodiments.

FIG. 2 illustrates a perspective view of the canisterized interceptor of FIG. 1 in accordance with some embodiments. As illustrated in FIG. 2, penetration of the canister by small arms fire 202 may be indicated by an open or short circuit in the conductive path provided by embedded winding 106.

Referring to FIGS. 1 and 2, in some embodiments, canisterized interceptor 100 may also include connector interface 110 for coupling conductor 108 to launch controller 112. Launch controller 112 may include circuitry to determine, among other things, when interceptor 101 is unsafe to fire by detecting either an open circuit or a short circuit in the conductive path. In some embodiments, connector interface 112 may be used for other signals, such as fire control signals, signals used to check the health and status of interceptor 101, and signals used to launch interceptor 101.

In some embodiments, composite canister 102 may include two or more conductors 108 embedded therein to provide two or more conductive paths (e.g., two or more loops). Connector interface 110 may be configured to couple at least one of the two or more conductors to launch controller 112. The circuitry of launch controller 112 may be configured to determine that interceptor 101 is not safe to fire when an open circuit is detected in one of the conductive paths. In these embodiments, the two or more conductors 108 provide for redundancy in the event that one of the conductive paths is broken during manufacture and/or transport. In these embodiments, a non-broken conductive path may be initially identified by the circuitry of launch controller 112, and may be used during operation to determine if composite canister 102 has been penetrated by small-arms fire. In these embodiments, when an open circuit is initially identified by the circuitry of launch controller 112, a non-broken conductive path provided by another conductor may be initially identified by the circuitry of launch controller 112 and checked for conductivity before launch.

In some embodiments, connector interface 110 may be used to access interceptor 101 including providing for monitoring of the status of interceptor 101 through an umbilical cable connection within composite canister 102. In some embodiments, connector interface 110 may be used to couple to push-and-twist type connectors.

In some embodiments, the circuitry of launch controller 112 may be configured to determine that interceptor 101 is not safe to fire when a short circuit to ground is detected on conductor 108. In these embodiments, the circuitry of launch controller 112 may be configured to detect an increase in current demand to detect a short circuit to ground. A current-demand detection circuit may be used which may include a current limiting device.

In some embodiments, to minimize potential electrical and magnetic interference with interceptor 101, the circuitry of launch controller 112 may minimize the voltage and current through the conductive path of embedded winding 106 during these health and status checks.

In some embodiments, launch controller 112 is coupled to a plurality of substantial identical composite canisters. Launch controller 112 may be configured to prevent the launch of any one of the canisterized interceptors when an open or short circuit is detected in a conductive path of embedded winding 106 of the associated composite canister. Launch controller 112 may select another canisterized interceptor for launch when an open or short circuit is detected in a composite canister. In these embodiments, launch controller 112 may, among other things, check for empty canisterized interceptors to determine which ones have already been launched.

In some embodiments, conductor 108 may be a non-insulated conductive filament wire fully embedded in composite canister 102 although the scope of the embodiments is not limited in this respect as the wire may also be insulated, and almost any type of insulated or non-insulated conductor may be used. In some embodiments, conductor 108 may comprise transformer wire having a thin insulating coating and may be fully embedded in composite canister 102. In these embodiments, the thin insulating coating may comprise a paint lacquer or enamel, a dye coating, or a plastic type coating, although the scope of the embodiments is not limited in this respect.

In some embodiments, conductor 108 may be embedded within composite material 104 during manufacture of the canister. Composite material 104 may comprise fiberglass, while in other embodiments, composite material 104 may comprise a carbon fiber material.

Canister 102 may include lid 114 to cover exit point 116 to provide a seal that protects the interior of the canister from dust, sand and moisture. The seal is intended to rupture upon launch and may be configured so as not to interfere with the launch. In some embodiments, lid 114 may have a conductor 109 embedded therein. A conductive path may be provided by the conductor 109 within lid 114 for detection of small arms fire penetrating lid 114. In these embodiments, the conductive path provided by the conductor 109 within lid 114 may also be coupled to launch controller 112 through a separate connector interface. Alternatively, instead of a separate connector interface, the conductive path within lid 114 and the conductive path within composite material 104 may be connected in series when lid 114 is placed on canister 102. In some alternate embodiments in which canister 102 is anticipated to be positioned during operational use so that small arms fire is unlike to penetrate lid 114, lid 114 may not necessarily include a conductive path.

In some embodiments, embedded winding 106 provides a conductive path substantially around composite canister 102 with a maximum spacing between the windings. The maximum spacing between the windings of embedded windings 106 may be selected to be approximately one-half the caliber of the smallest small arms round anticipated to penetrate the canister, although the scope of the embodiments is not limited in this respect. In some embodiments, a spacing of five wire diameters may be provided by conductor 108 of embedding winding 106. In other embodiments, a nominal spacing of one wire diameter may be provided. In some embodiments, a minimum spacing of approximately one wire diameter may be provided, although the scope of the embodiments is not limited in this respect.

In some alternate embodiments, rather than being embedded in canister 102, conductor 108 may be wrapped around the external surface of the canister 102. In these embodiments, an aluminum canister may be used with an insulated conductor, although the scope of the embodiments is not limited in this respect.

Some embodiments of the present invention provide an active defense system. The active defense system may include a plurality of canisterized interceptors 100 and launch controller 112. Each of canisterized interceptors 100 may comprise composite canister 102 for housing interceptor 101 and may have winding 106 embedded in composite material 104 to provide a conductive path. Embedded winding 106 may comprise conductor 108 and may provide a maximum spacing between windings of conductor 108. In these embodiments, launch controller 112 may be coupled to the conductive path of each canisterized interceptor 100 to detect penetration of small arms fire by detection of an open or short circuit in one of the conductive paths. In these embodiments, launch controller 112 may refrain from launching an interceptor when an open or short circuit is detected in its canister.

Figure 3:
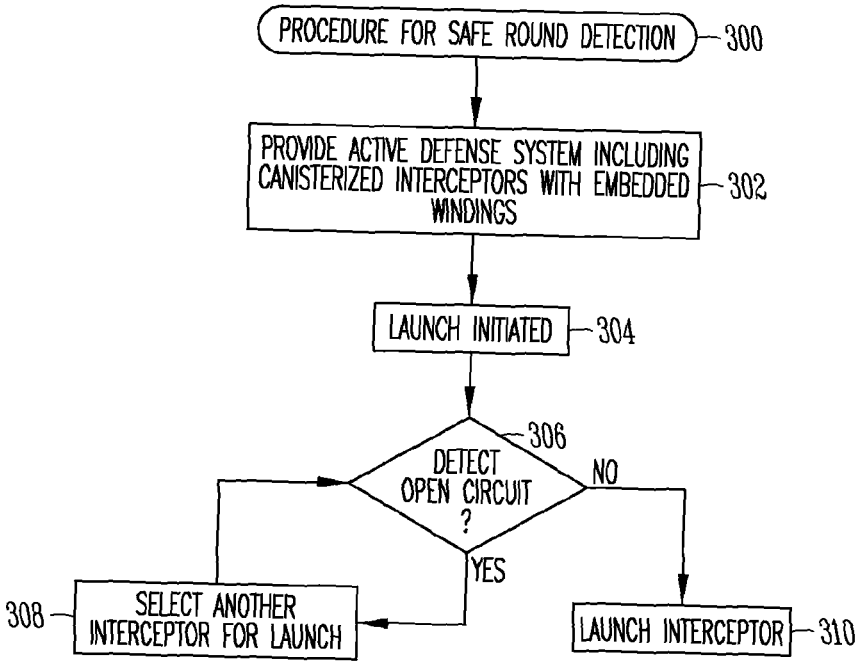
FIG. 3 is a procedure for safe round detection in accordance with some embodiments.

FIG. 3 is a procedure for safe round detection in accordance with some embodiments. Safe round detection procedure 300 may be performed by a launch controller, such as launch controller 112 (FIG. 1), to detect if an interceptor has been penetrated by small arms fire and is unsafe to launch.

Operation 302 includes providing an active defense system that includes canisterized interceptors with embedded windings. Canisterized interceptor 100 (FIG. 1), may be suitable for use as the canisterized interceptors provided in operation 302.

In operation 304, a launch is initiated and one of the canisterized interceptors is selected for launch.

In operation 306, the embedded windings of the selected interceptor are checked for an open circuit. When an open circuit is detected, the selected canisterized interceptor may have been penetrated by small arms fire and operation 308 is performed. When a conductive path through the windings is detected, the selected canisterized interceptor is not likely to have been penetrated by small arms fire and operation 310 is performed. In some embodiments, operation 306 may also check for a short circuit to ground.

In operation 308, launch controller 112 refrains from launching the selected canisterized interceptor and another canisterized interceptor is selected for launch. After operation 308, operation 306 is repeated for the canisterized interceptor selected in operation 308.

In operation 310, the interceptor is launched. Launch controller 112 (FIG. 1) may perform other tests and checks on the selected interceptor prior to launch to verify that the selected interceptor is ready to launch. In some embodiments, these tests and checks may be performed prior to checking for a conductive path in the embedding windings 106 (FIG. 1), although the scope of the embodiments is not limited in this respect.

Although the individual operations of procedure 300 are illustrated and described as separate operations, one or more of the individual operations may be performed concurrently, and nothing requires that the operations be performed in the order illustrated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A canisterized interceptor comprising:

a composite canister for housing an interceptor, the composite canister constructed with a canister material; and a winding embedded within the composite canister to provide a conductive path, wherein the embedded winding comprises a conductor having a wire diameter with a plurality of passes arranged within composite material of the canister as a looped coil to provide a maximum spacing between adjacent passes of the conductor of the looped coil embedded winding, wherein the spacing between adjacent passes of the looped coil embedded winding is five wire diameters, a connector interface coupled with the conductor;

a launch controller coupled with the connector interface, the launch controller includes circuitry configured to determine whether the interceptor is safe to fire by detecting either a closed or an open circuit in the conductive path of the looped coil embedded winding; and wherein penetration of the canister is indicated by an open circuit in the conductive path of the looped coil embedded winding.

2. The canisterized interceptor of claim 1, wherein the launch controller is coupled to a plurality of identical composite canisters, and the launch controller is configured to:

prevent the launch of a first canisterized interceptor of the plurality when an open circuit is detected in a conductive path of an embedded winding of the associated composite canister; and select a second canisterized interceptor for launch when an open circuit is detected in the composite canister of the first canisterized interceptor.

3. The canisterized interceptor of claim 1 wherein the conductor is embedded within the composite material during manufacture of the canister.

4. The canisterized interceptor of claim 3 wherein the conductor comprises a non-insulated conductive filament wire fully embedded in the composite canister.

5. The canisterized interceptor of claim 3 wherein the conductor comprises transformer wire having a thin insulating coating fully embedded in the composite canister.

6. The canisterized interceptor of claim 3 wherein the composite material comprises fiberglass.

7. The canisterized interceptor of claim 3 wherein the composite material comprises a carbon fiber material.

8. The canisterized interceptor of claim 3 wherein the embedded winding provides the conductive path around the canister with the maximum spacing between the windings.

9. The canisterized interceptor of claim 8 wherein the canister further comprises a lid having a second conductor embedded therein to cover an exit point of the interceptor, and wherein a second conductive path is provided by the second conductor within the lid for detection of small-arms fire penetrating the lid.

10. The canisterized interceptor of claim 3 further comprising two or more conductors embedded in the canister to provide a corresponding two or more conductive paths, wherein the connector interface is configured to couple at least one of the two or more conductors to the launch controller, and wherein the circuitry of the launch controller is configured to determine that the interceptor is not safe to fire when an open circuit is detected in one of the conductive paths.

11. The canisterized interceptor of claim 10 wherein when an open circuit in one of the conductors of the two or more conductors is initially identified by the circuitry of the launch controller, a non-broken conductive path of at least one of the two or more conductors is initially identified by the circuitry of the launch controller and checked for conductivity before launch.

12. The canisterized interceptor of claim 10 wherein the circuitry of the launch controller is further configured to determine that the interceptor is not safe to fire when a short circuit to ground is detected in one of the conductive paths.

13. An active defense system comprising:

a plurality of canisterized interceptors; and a launch controller;

wherein each of the canisterized interceptors comprises a composite canister for housing an interceptor, each of the composite canisters constructed with a canister material, each of the composite canisters including a winding embedded in the canister to provide a conductive path, the embedded winding comprising a conductor having a wire diameter with a plurality of passes as a looped coil to provide equal spacing between adjacent passes of the looped coil embedded winding of the conductor, wherein the equal spacing between adjacent passes of the looped coil embedded winding is one or five wire diameters; and wherein the launch controller is coupled to the conductive path of each canisterized interceptor to detect penetration of any one of the canisterized interceptors by detection of an open circuit in a corresponding one of the conductive paths in the looped coil embedded winding.

14. The system of claim 13 wherein the launch controller is configured to:

prevent the launch of a first canisterized interceptor of the plurality when an open circuit is detected in a conductive path of an embedded winding of the associated composite canister; and select a second canisterized interceptor for launch when an open circuit is detected in the composite canister of the first canisterized interceptor.

15. The system of claim 13 wherein the conductor of each canisterized interceptor is embedded within the composite material during manufacture of the canister, wherein the embedded winding of each canisterized interceptor provides a conductive path around the canister with the equal spacing between the windings.

16. A method of detecting whether a canisterized interceptor has been penetrated by small-arms fire comprising:

providing the canisterized interceptor having a composite canister constructed with a canister material for housing an interceptor and having a winding embedded in the canister, the embedded winding including a conductor having a wire diameter with a plurality of passes embedded in the canister as a looped coil, adjacent passes of the conductor of the looped coil embedded winding are spaced according to an equal spacing, wherein the equal spacing between adjacent passes of the looped coil embedded winding is one or five wire diameters; and detecting an open circuit in a conductive path provided by the conductor of the looped coil embedded winding, the open circuit indicating penetration by small-arms fire; and refraining from launching an interceptor that is housed within the composite canister when an open circuit is detected.

17. The method of claim 16 further comprising:

preventing a launch of a first canisterized interceptor of a plurality of canisterized interceptors when the open circuit is detected in the conductive path of the embedded winding of the associated composite canister; and selecting a second canisterized interceptor for launch when the open circuit is detected in the composite canister of the first canisterized interceptor.

18. The method of claim 17 wherein the conductor is embedded within the composite material during manufacture of the canister, and wherein the embedded winding provides the conductive path around the canister with the equal spacing between the windings.

19. The system of claim 13, wherein the equal spacing between adjacent passes is one wire diameter.

20. The system of claim 13, wherein the equal spacing between adjacent passes is five wire diameters.

21. The method of claim 16, wherein the equal spacing between adjacent passes is one wire diameter.

22. The method of claim 16, wherein the equal spacing between adjacent passes is five wire diameters.

* * * * *